US007010480B2

(12) United States Patent
Gao et al.

(10) Patent No.: US 7,010,480 B2
(45) Date of Patent: Mar. 7, 2006

(54) CONTROLLING A WEIGHTING FILTER BASED ON THE SPECTRAL CONTENT OF A SPEECH SIGNAL

(75) Inventors: Yang Gao, Mission Viejo, CA (US); Huan-Yu Su, San Clemente, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 745 days.

(21) Appl. No.: 09/953,470

(22) Filed: Sep. 13, 2001

(65) Prior Publication Data

US 2002/0116182 A1 Aug. 22, 2002

Related U.S. Application Data

(60) Provisional application No. 60/233,044, filed on Sep. 15, 2000.

(51) Int. Cl.
*G10L 19/04* (2006.01)

(52) U.S. Cl. ..... 704/219; 704/203; 704/205; 704/200.1; 704/218; 704/223

(58) Field of Classification Search ..... 704/218, 704/223, 200.1, 203, 205, 219
See application file for complete search history.

(56) References Cited

U.S. PATENT DOCUMENTS 5,295,224 A 3/1994 Makamura et al.
5,633,980 A 5/1997 Ozawa
5,664,055 A * 9/1997 Kroon ..... 704/223
5,717,618 A 2/1998 Menkhoff et al.
5,806,022 A 9/1998 Rahim et al.
5,845,244 A 12/1998 Proust
6,636,829 B1 * 10/2003 Benyassine et al. ..... 704/201
6,807,524 B1 * 10/2004 Bessette et al. ..... 704/200.1

OTHER PUBLICATIONS

JP 08-328600 (Nakagawa) Dec. 13, 1996, all.
Vergin et al, Compensated MEL Frequency Cepstrum Coefficients, IEEE International Conference on Acoustics, Speech, and Signal Processing, May 1996, pp. 323-326 vol. 1.
Bakkaloglu et al, A Voice-Band Audio Processor IC for CDMA Applications, Midwest Symposium on Circuits and Systems, Aug. 1998, pp. 484-487.

* cited by examiner

*Primary Examiner*—W. R. Young
*Assistant Examiner*—Jakieda R Jackson
(74) *Attorney, Agent, or Firm*—Farjami & Farjami LLP

(57) ABSTRACT

A method for preparing a speech signal for encoding comprises determining whether the spectral content of an input speech signal is representative of a defined spectral characteristic (e.g., a defined characteristic slope). A frequency specific filter component of a weighting filter is controlled based on the determination of the spectral content of the speech signal or/and its location in the encoder. A core weighting filter component of the weighting filter may be maintained regardless of the spectral content of the speech signal.

29 Claims, 11 Drawing Sheets

CONTROLLING A WEIGHTING FILTER BASED ON THE SPECTRAL CONTENT OF A SPEECH SIGNAL

CROSS REFERENCE TO RELATED APPLICATIONS

This application claims the benefit of provisional application Ser. No. 60/233,044, entitled SIGNAL PROCESSING SYSTEM FOR FILTERING SPECTRAL CONTENT OF A SIGNAL FOR SPEECH ENCODING, filed on Sep. 15, 2000 under 35 U.S.C. 119(e).

BACKGROUND OF THE INVENTION

1. Technical Field

This invention relates to a method and system for controlling a weighting filter based on the spectral content of the input speech signal, among other possible factors.

2. Related Art

An analog portion of a communications network may detract from the desired audio characteristics of vocoded speech. In a public switched telephone network, a trunk between exchanges or a local loop from a local office to a fixed subscriber station may use analog representations of the speech signal. For example, a telephone station typically transmits an analog modulated signal with approximately 3.4 KHz bandwidth to the local office over the local loop. The local office may include a channel bank that converts the analog signal to a digital pulse-code-modulated signal (e.g., DS0). An encoder in a base station may subsequently encode the digital signal, which remains subject to the frequency response originally imparted by the analog local loop, the telephone, and the speaker.

The analog portion of the communications network may skew the frequency response of a voice message transmitted through the network. A skewed frequency response may negatively impact the digital speech coding process because the digital speech coding process may be optimized for a different frequency response than the skewed frequency response. As a result, analog portion may degrade the intelligibility, consistency, realism, clarity or another performance aspect of the digital speech coding.

The change in the frequency response may be modeled as one or more modeling filters interposed in a path of the voice signal traversing an ideal analog communications network with an otherwise flat spectral response. A Modified Intermediate Reference System (MIRS) refers to a modeling filter or another model of the spectral response of a voice signal path in a communications network. If a voice signal that has a flat spectral response is inputted into an MIRS filter, the output signal has a sloped spectral response with an amplitude that generally increases with a corresponding increase in frequency.

In the prior art, an encoder may use weighting filters with identical responses for a pitch-preprocessing weighting filter, an adaptive-codebook weighting filter, and a fixed-codebook weighting filter. The adaptive-codebook weighting filter may be used for open-loop pitch estimation. If identical filters are used for pitch pre-processing and open-loop pitch estimation and if the input speech has a skewed spectral response (e.g., MIRS response), the encoded speech signal may be degraded in perceptual quality. For example, if the input speech signal to the pitch-preprocessing weighting filter has an MIRS spectral response, the output speech signal from the pitch-preprocessing weighting filter may not be as periodic as it otherwise might be with a different spectral response of the input speech signal. Accordingly, the output of the pitch-preprocessing weighting filter may not be sufficiently periodic to capture coding efficiencies or perceptual aspects associated with generally periodic speech. Thus, the need exists for a pitch-preprocessing weighting filter that addresses the spectral response of the input speech signal to enhance the periodicity of the weighted speech signal.

If identical weighting filters are used for both open-loop pitch estimation and fixed-codebook search, the bandwidth of the encoded speech and the perceptual quality of the encoded speech may be degraded. For example, the weighting filters may filter out unwanted noise from the input speech signal, which may lead incidentally to a reduced bandwidth of the encoded speech signal. If the input speech signal has a desired noise component or another speech component that requires a wide bandwidth for accurate encoding, the weighting filters may attenuate the speech noise component of the encoded speech to such a degree that the encoded speech sounds artificial or synthetic when reproduced. Thus, a need exists for weighting filters of an encoder that filter out unwanted noise and yet maintain the appropriate bandwidth necessary for a perceptually accurate reproduction of the speech.

SUMMARY

In accordance with the invention, a method for preparing a speech signal for encoding comprises determining whether the spectral content of an input speech signal is representative of a defined spectral characteristic (e.g., a defined characteristic slope). A weighting filter may be associated with a particular portion of the encoder and may comprise a frequency-specific component that has a response tailored to the particular portion of the encoder, consistent with perceptual quality considerations of the reproduced speech signal. A frequency-specific filter component of a weighting filter is controlled based on one or more of the following: the determination of the spectral content of the speech signal and an affiliation of the encoder with a particular portion of the encoder. A core weighting filter component of the weighting filter may be maintained regardless of the spectral content of the speech signal.

The frequency specific filter component of a weighting filter may include a low-pass filter component, a high-pass filter component, or some other filter component. In one example, a low-pass filter component of a pre-processing weighting filter is controlled based on the determination of the spectral content of the input speech signal to enhance the periodicity of the weighted speech. In another example, a high-pass filter component of a fixed codebook weighting filter is controlled based on the determination of the spectral content of the speech signal to enhance the perceptual quality of reproduced speech, derived from the encoded speech.

In accordance with another aspect of the invention, if multiple weighting filters are used in the encoder, the responses of at least two weighting filters may differ to correspond to the speech processing objectives of specific portions of the encoder, consistent with achieving a desired level of perceptual quality of the speech signal. In other words, different weighting filter responses could be used for different portions of the encoder to enhance the perceptual quality of the reproduced speech.

Other systems, methods, features and advantages of the invention will be apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

Like reference numerals designate corresponding elements throughout the different figures.

DETAILED DESCRIPTION OF THE PREFERRED EMBODIMENT

The term coding refers to encoding of a speech signal, decoding of a speech signal or both. An encoder codes or encodes a speech signal, whereas a decoder codes or decodes a speech signal. The encoder may determine certain coding parameters that are used both in an encoder to encode a speech signal and a decoder to decode the encoded speech signal. The term coder refers to an encoder or a decoder.

Figure 1I:
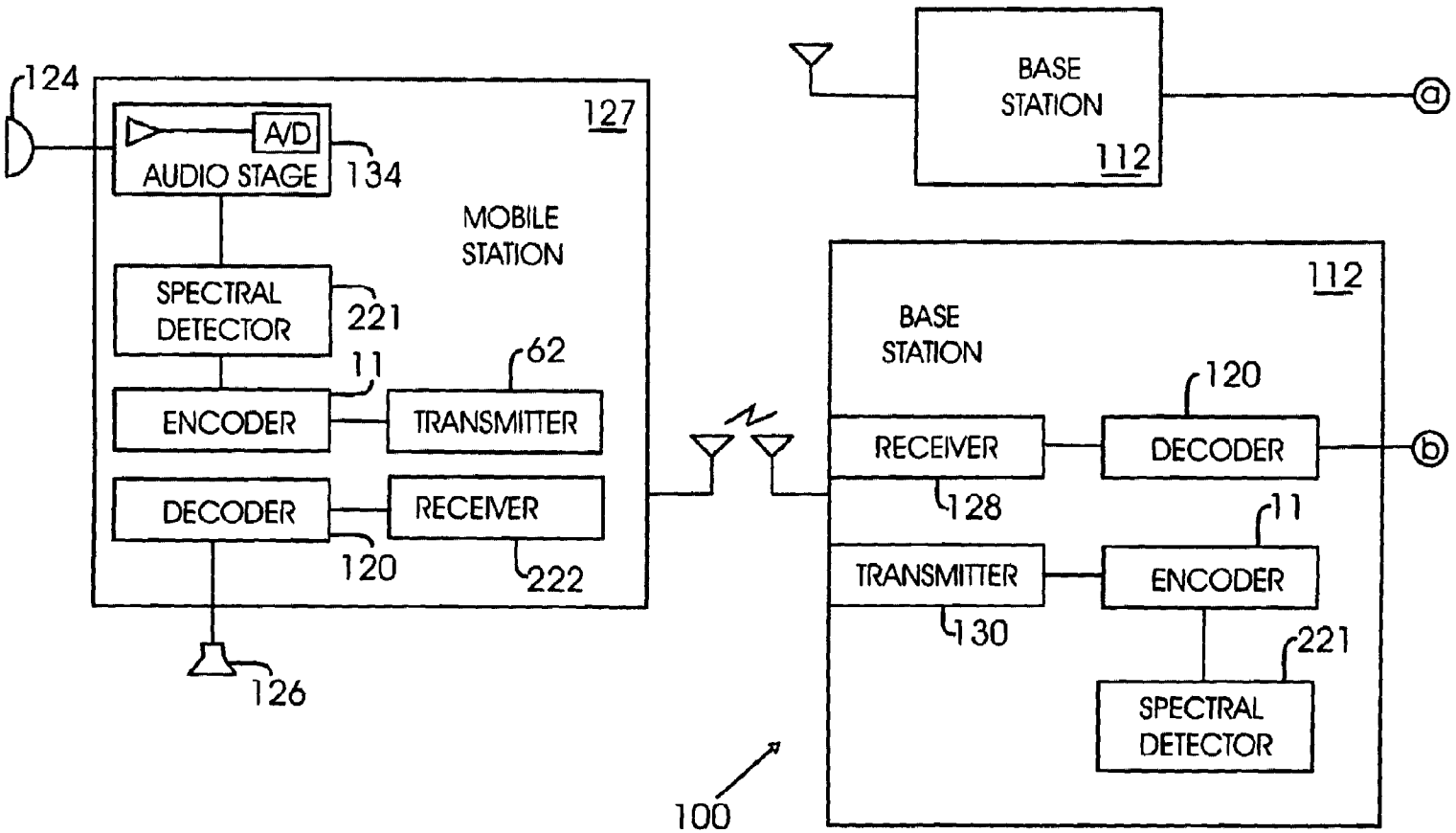
FIG. 1 is a block diagram of a communications system incorporating an encoder in accordance with the invention.
Figure 1:
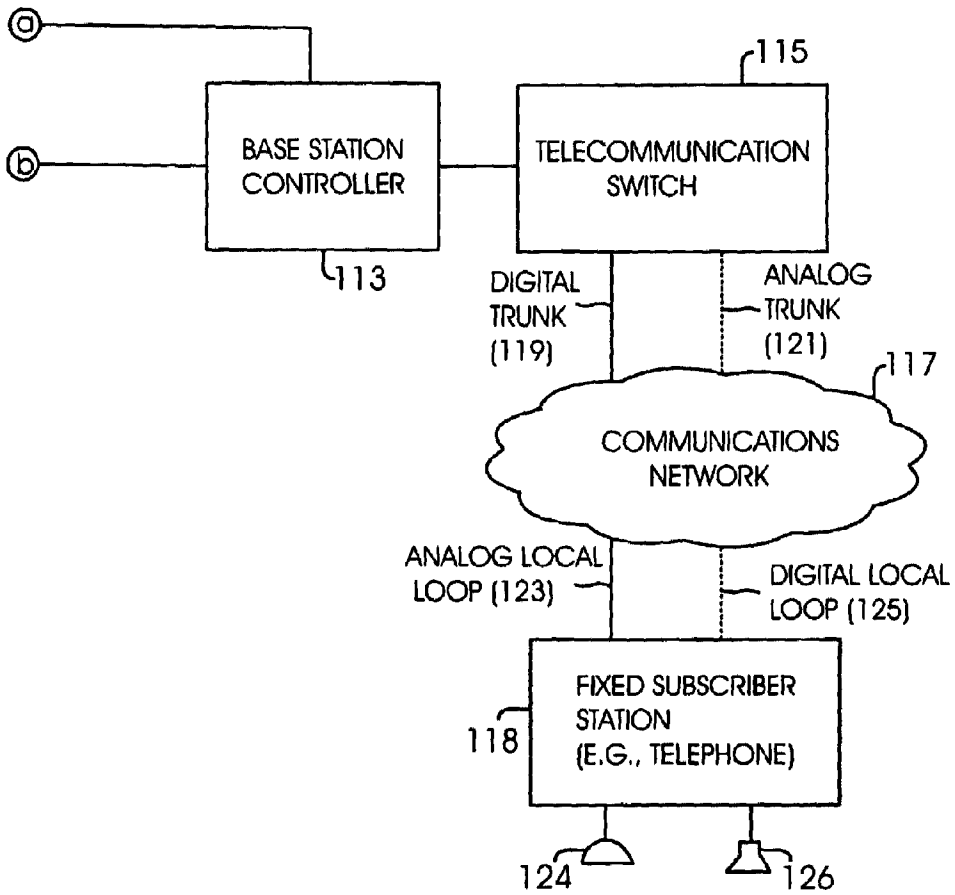

FIG. 1 shows a block diagram of a communications system 100 that incorporates an encoder 11. The communications system 100 includes a mobile station 127 that communicates to a base station 112 via electromagnetic energy (e.g., radio frequency signal) consistent with an air interface. In turn, the base station 112 may communicate with a fixed subscriber station 118 via a base station controller 113, a telecommunications switch 115, and a communications network 117. The base station controller 113 may control access of the mobile station 127 to the base station 112 and allocate a channel of the air interface to the mobile station 127. The telecommunications switch 115 may provide an interface for a wireless portion of the communications system 100 to the communications network 117.

For an uplink transmission from the mobile station 127 to the base station 112, the mobile station 127 has a microphone 124 that receives an audible speech message of acoustic vibrations from a speaker or source. The microphone 124 transduces the audible speech message into a speech signal. In one embodiment, the microphone 124 has a generally flat spectral response across a bandwidth of the audible speech message so long as the speaker has a proper distance and position with respect to the microphone 124. An audio stage 134 preferably amplifies and digitizes the speech signal. For example, the audio stage 134 may include an amplifier with its output coupled to an input of an analog-to-digital converter. The audio stage 134 inputs the speech signal into the spectral detector 221.

A spectral detector 221 detects the spectral contents or spectral response of the speech signal. In one embodiment, the spectral detector 221 determines whether or not the spectral contents conform to a defined spectral slope (e.g., an MIRS response). A spectral response refers to the energy distribution (e.g., magnitude versus frequency) of the voice signal over at least part of the bandwidth of the voice signal. A flat spectral response refers to an energy distribution that generally keeps the original spectrum of input speech signal over the bandwidth. A sloped spectral response refers to an energy distribution that generally tilts the original spectral response (of an inputted speech signal) with respect to frequency of the inputted speech signal.

An MIRS spectral response refers to an energy distribution where an inputted speech signal is tilted upward in magnitude for a corresponding increase in frequency. For both a flat and MIRS speech signal, the energy distribution is usually not evenly distributed over the bandwidth of the speech signal.

A first spectral response refers to a voice signal with a sloped spectral response where the higher frequency components have relatively greater amplitude than the average amplitude of other frequency components of the voice signal. A second spectral response refers to a voice signal where the higher frequency components have approximately equal amplitudes to lower frequency components, or where amplitudes are within a range of each other. A third spectral response refers to a voice signal where the higher frequency components have relatively lower amplitude than the average amplitude of other frequency components of the voice signal.

At the mobile station 127, the spectral response of the outgoing speech signal may be influenced by one or more of the following factors: (1) frequency response of the microphone 124, (2) position and distance of the microphone 124 with respect to a source (e.g., speaker's mouth) of the audible speech message, and (3) frequency response of an audio stage 134 that amplifies the output of the microphone 124. The spectral response of the outgoing speech signal, which is inputted into the spectral detector 221, may vary. In one example, the spectral response may be generally flat with respect to most frequencies over the bandwidth of the speech message. In another example, the spectral response may have a slope that indicates an amplitude that increases with frequency over the bandwidth of the speech message. For instance, an MIRS response has an amplitude that increases with a corresponding increase in frequency over the bandwidth of the speech message.

The encoder 11 reduces redundant information in the speech signal or otherwise reduces a greater volume of data of an input speech signal to a lesser volume of data of an encoded speech signal. The encoder 11 may comprise a coder, a vocoder, a codec, or another device for facilitating efficient transmission of information over the air interface between the mobile station 127 and the base station 112. In one embodiment, the encoder 11 comprises a code-excited linear prediction (CELP) coder or a variant of the CELP coder. In an alternate embodiment, the encoder 11 may comprise a parametric coder, such as a harmonic encoder or a waveform-interpolation encoder. The encoder 11 is coupled to a transmitter 62 for transmitting the coded signal over the air interface to the base station 112.

The base station 112 may include a receiver 128 coupled to a decoder 120. At the base station 112, the receiver 128 receives a transmitted signal transmitted by the transmitter 62. The receiver 128 provides the received speech signal to the decoder 120 for decoding and reproduction on the speaker 126 (i.e., transducer). A decoder 120 reconstructs a replica or facsimile of the speech message inputted into the microphone 124 of the mobile station 127. The decoder 120 reconstructs the speech message by performing inverse operations on the encoded signal with respect to the encoder 11 of the mobile station 127. The decoder 120 or an affiliated communications device sends the decoded signal over the network to the subscriber station (e.g., fixed subscriber station 118).

For a downlink transmission from the base station 112 to the mobile station 127, a source at the fixed subscriber station 118 (e.g., a telephone set) may speak into a microphone 124 of the fixed subscriber station 118 to produce a speech message. The fixed subscriber station 118 transmits the speech message over the communications network 117 via one of various alternative communications paths to the base station 112.

Each of the alternate communications paths may provide a different spectral response of the speech signal that is applied to the spectral detector 221 of the base station 112. Three examples of communications paths are shown in FIG. 1 for illustrative purposes, although an actual communications network (e.g., a switched circuit network or a data packet network with a web of telecommunications switches) may contain virtually any number of alternative communication paths. In accordance with a first communications path, a local loop between the fixed subscriber station 118 and a local office of the communications network 117 represents an analog local loop 123, whereas a trunk between the communications network 117 and the telecommunications switch 115 is a digital trunk 119. In accordance with second communications path, the speech signal traverses a digital signal path through synchronous digital hierarchy equipment, which includes a digital local loop 125 and a digital trunk 119 between the communications network 117 and the telecommunications switch 115. In accordance with a third communications path, the speech signal traverses over an analog local loop 123 and an analog trunk 121 (e.g., frequency-division multiplexed trunk) between the communications network 117 and the telecommunications switch 115, for example.

The spectral response of any of the three illustrative communications paths may be flat or may be sloped. The slope may or may not be consistent with an MIRS model of a telecommunications system, although the slope may vary from network to network.

The encoder 11 at the base station 112 encodes the speech signal from the spectral detector 221. For a downlink transmission, the transmitter 130 transmits an encoded signal over the air interface to a receiver 222 of the mobile station 127. The mobile station 127 includes a decoder 120 coupled to the receiver 222 for decoding the encoded signal. The decoded speech signal may be provided in the form of an audible, reproduced speech signal at a speaker 126 or another transducer of the mobile station 127.

Figure 2A:
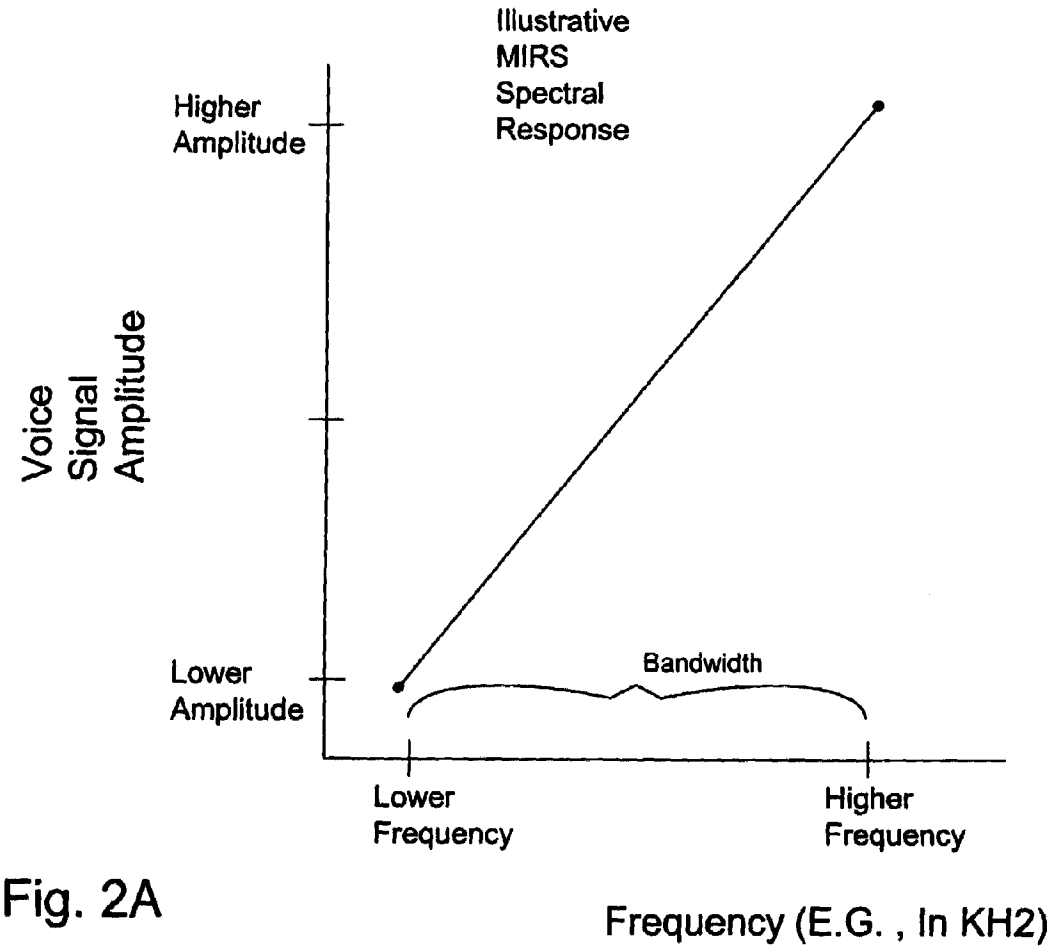
FIG. 2A is a graph of an illustrative sloped spectral response of a speech signal with an amplitude that that increases with a corresponding increase in frequency.
Figure 2B:
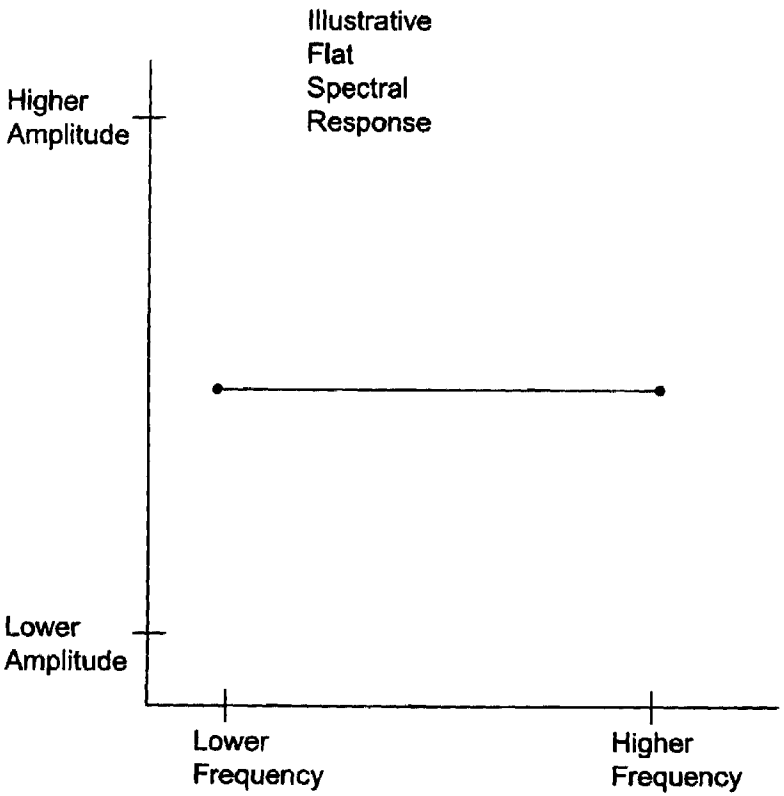
FIG. 2B is a graph of an illustrative flat spectral response of a speech signal with a generally constant amplitude over different frequencies.

FIG. 2A and FIG. 2B show illustrative examples of the defined characteristic slope and the flat spectral response, respectively. In practice, the defined characteristic slope or the flat spectral response may be defined in accordance with geometric equations or by entries within one or more look-up tables of a reference parameter database. The reference parameter database may be stored in the spectral detector 221 or the encoder 11.

FIG. 2A may represent the first spectral response, as previously defined herein. For example, FIG. 2A shows an illustrative graph of a positively sloped spectral response (e.g., MIRS spectral response) associated with a network with at least one analog portion. The vertical axis represents an amplitude of the response. The horizontal axis represents the frequency of the response. The spectral response is sloped or tilted, such that the amplitude of the voice signal increases with a corresponding increase in the frequency of the voice signal. The voice signal may have a bandwidth that ranges from a lower frequency to a higher frequency. At the lower frequency, the spectral response has a lower amplitude than the original response of an input speech signal while at the higher frequency the spectral response has a higher amplitude than the original spectral response of the input speech signal.

An MIRS speech signal may be formed because of the network or filtering which tilts the original spectral response of an inputted speech signal. The MIRS speech signal contains more high-frequency energy than the original response of the inputted speech signal, but could still have a negative or a positive tilt because of the underlying slope of the original spectral response. In the context of an MIRS response, the slope shown in FIG. 2A may represent a 6 dB per octave (i.e., a standard measure of change in frequency) slope.

Although the slope shown in FIG. 2A is generally linear, in an alternate example of spectral response, the slope may be depicted as a curved slope.

FIG. 2B is a graph of a flat spectral response. A flat spectral response may be associated with a network with predominately digital infrastructure. A flat spectral response generally means that the original spectral tilt of the input speech signal is not changed. Flat speech has the same tilt as the original spectral response of an inputted speech signal and, hence, could still have negative or positive tilt. In practice, the average tilt of MIRS speech may be "higher" than the flat speech for the same speaker or input speech signal.

For example, FIG. 2B may represent the second spectral response, as previously defined herein. The vertical axis represents an amplitude of the response. The horizontal axis represents a frequency of the response. The flat spectral response generally has a slope approaching zero, as expressed by the generally horizontal line extending intermediately between the higher amplitude and the lower amplitude. Accordingly, the flat spectral response has approximately the same intermediate amplitude at the lower frequency and the higher frequency. The horizontal line that intercepts the peak amplitudes of the response indicates that the spectral response is generally flat and the horizontal line is present only for illustrative purposes.

Figure 3I:
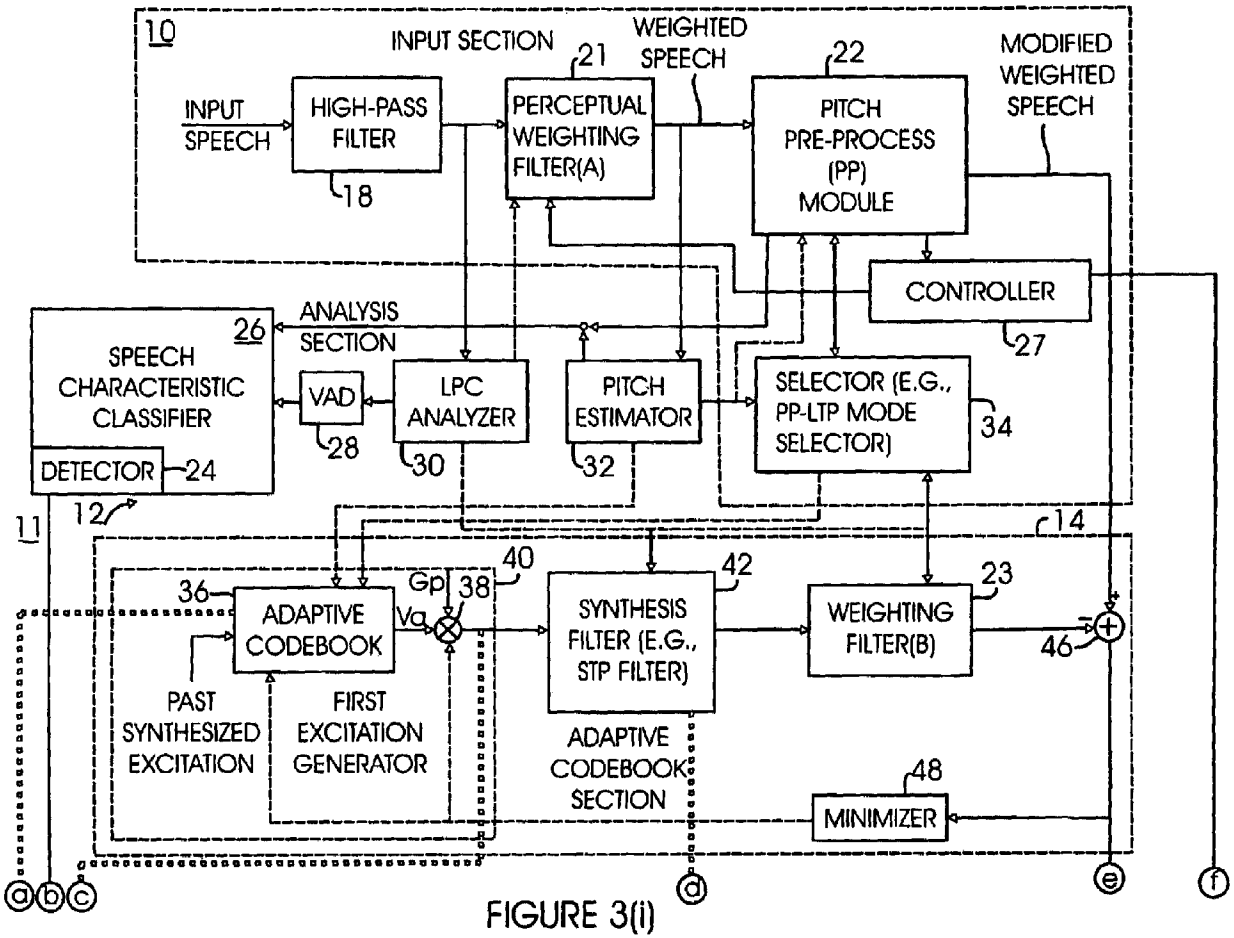
FIG. 3 is a block diagram that shows an encoder of FIG. 1 in accordance with the invention.
Figure 3:
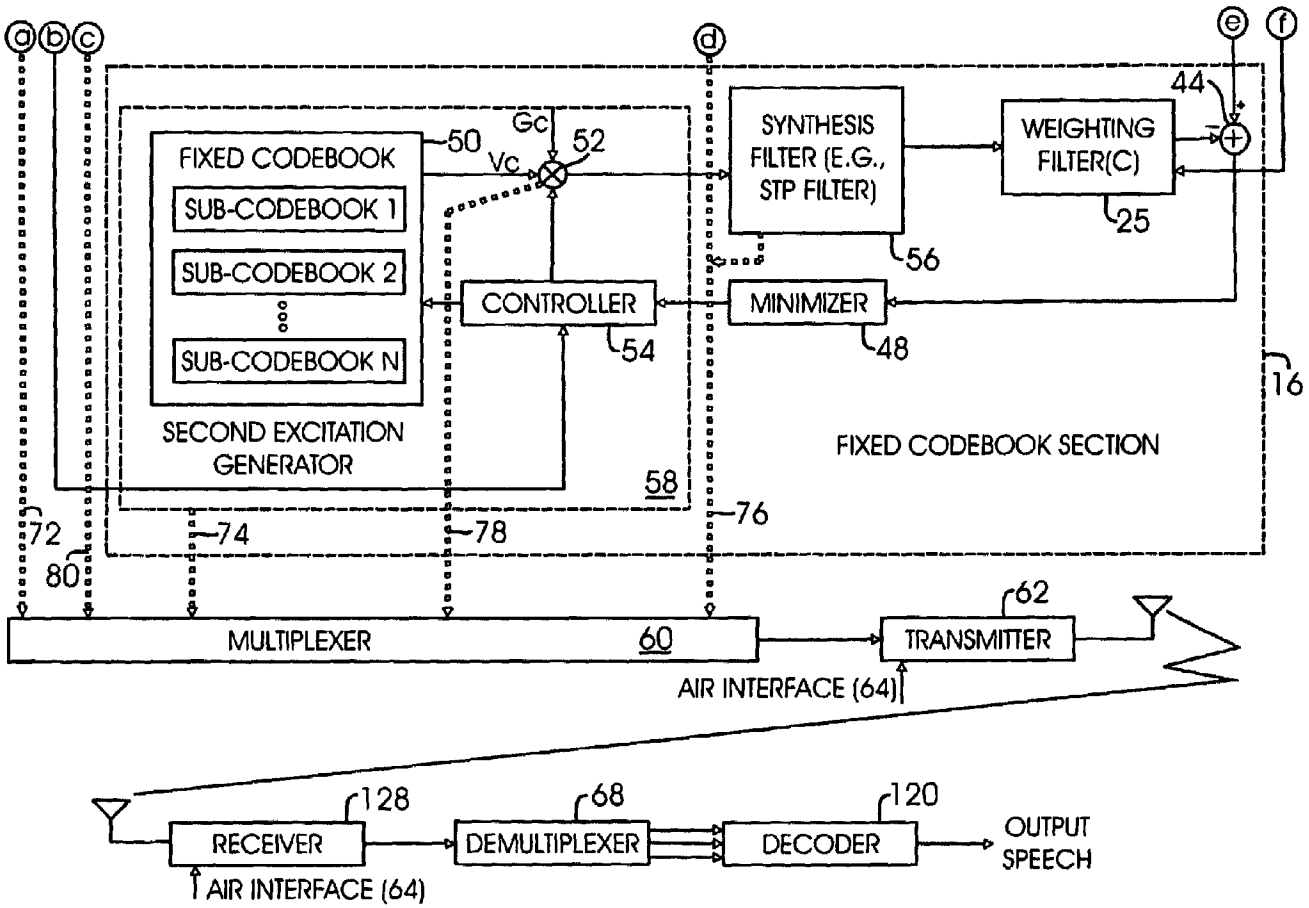

FIG. 3 shows an illustrative embodiment of the encoder 11. Like reference numbers indicate like elements in FIG. 1 and FIG. 3. FIG. 3 primarily illustrates the uplink signal path of FIG. 1. FIG. 3 illustrates the details of one illustrative configuration of the encoder 11. Further, FIG. 3 includes a multiplexer 60 and a demultiplexer 68, which were omitted from FIG. 1 solely for the sake of simplicity.

The encoder 11 includes an input section 10 coupled to an analysis section 12 and an adaptive codebook section 14. In turn, the adaptive codebook section 14 is coupled to a fixed codebook section 16. A multiplexer 60, associated with both the adaptive codebook section 14 and the fixed codebook section 16, is coupled to a transmitter 62.

The transmitter 62 and a receiver 128 along with a communications protocol represent an air interface 64 of a wireless system. The input speech from a source or speaker is applied to the encoder 11 at the encoding site. The transmitter 62 transmits an electromagnetic signal (e.g., radio frequency or microwave signal) from an encoding site to a receiver 128 at a decoding site, which is remotely situated from the encoding site. The electromagnetic signal is modulated with reference information representative of the input speech signal. A demultiplexer 68 demultiplexes the reference information for input to the decoder 120. The decoder 120 produces a replica or representation of the input speech, referred to as output speech, at the decoder 120.

The input section 10 has an input terminal for receiving an input speech signal. The input terminal feeds a high-pass filter 18 that attenuates the input speech signal below a cut-off frequency (e.g., 80 Hz) to reduce noise in the input speech signal. The high-pass filter 18 feeds a pre-processing weighting filter 21 and a linear predictive coding (LPC) analyzer 30. The pre-processing weighting filter 21 may feed both a pitch pre-processing module 22 and a pitch estimator 32. Further, the pre-processing weighting filter 21 may be coupled to an input of a first summer 46 via the pitch pre-processing module 22.

In one embodiment, a speech characteristic classifier 26 comprises a detector 24. The detector 24 may refer to a classification unit that (1) identifies noise-like unvoiced speech and (2) distinguishes between non-stationary voiced and stationary voiced speech in an interval of an input speech signal. The detector 24 may detect or facilitate detection of the presence or absence of a triggering characteristic (e.g., a generally voiced and generally stationary speech component) in an interval of input speech signal. In another embodiment, the detector 24 may be integrated into the speech characteristic classifier 26 to detect a triggering characteristic in an interval of the input speech signal. Where the detector 24 is so integrated, the speech characteristic classifier 26 is coupled to a selector 34.

The analysis section 12 includes the LPC analyzer 30, the pitch estimator 32, a voice activity detector 28, a speech characteristic classifier 26, and a controller 27. The LPC analyzer 30 is coupled to the voice activity detector 28 for detecting the presence of speech or silence in the input speech signal. The pitch estimator 32 is coupled to a mode selector 34 for selecting a pitch pre-processing procedure or a responsive long-term prediction procedure based on input received from the detector 24. The controller 27 controls the pre-processing weighting filter 21, the adaptive-codebook weighting filter 25, or both based on the spectral content of the speech signal. The pre-processing weighting filter 21, the adaptive-codebook weighting filter 25, or the fixed-codebook weighting filter 23 may be referred to generally as a weighting filter.

The adaptive codebook section 14 includes a first excitation generator 40 coupled to a synthesis filter 42 (e.g., short-term predictive filter). In turn, the synthesis filter 42 feeds an adaptive-codebook weighting filter 23. The adaptive-codebook weighting filter 23 is coupled to an input of the first summer 46, whereas a minimizer 48 is coupled to an output of the first summer 46. The minimizer 48 provides a feedback command to the first excitation generator 40 to minimize an error signal at the output of the first summer 46. The adaptive codebook section 14 is coupled to the fixed codebook section 16 where the output of the first summer 46 feeds the input of a second summer 44 with the error signal.

The fixed codebook section 16 includes a second excitation generator 58 coupled to a synthesis filter 42 (e.g., short-term predictive filter). In turn, the synthesis filter 42 feeds a fixed-codebook weighting filter 25. The fixed-codebook weighting filter 25 is coupled to an input of the second summer 44, whereas a minimizer 48 is coupled to an output of the second summer 44. A residual signal is present at the output of the second summer 44. The minimizer 48 provides a feedback command to the second excitation generator 58 to minimize the residual signal.

In one alternate embodiment, the synthesis filter 42 and the adaptive-codebook weighting filter 23 of the adaptive codebook section 14 are combined into a single filter.

In another alternate embodiment, the synthesis filter 42 and the fixed-codebook weighting filter 25 of the fixed codebook section 16 are combined into a single filter. In yet another alternate embodiment, the three perceptual weighting filters (21, 23, and 25) of the encoder 11 may be replaced by two perceptual weighting filters, where each remaining perceptual weighting filter is coupled in tandem with the input of one of the minimizers 48. Accordingly, in the foregoing alternate embodiment the pre-processing weighting filter 21 from the input section 10 is deleted.

In accordance with FIG. 3, an input speech signal is inputted into the input section 10. The input section 10 decomposes speech into component parts including (1) a short-term component or envelope of the input speech signal, (2) a long-term component or pitch lag of the input speech signal, and (3) a residual component that results from the removal of the short-term component and the long-term component from the input speech signal. The encoder 11 uses the long-term component, the short-term component, and the residual component to facilitate searching for the preferential excitation vectors of the adaptive codebook 36 and the fixed codebook 50 to represent the input speech signal as reference information for transmission over the air interface 64.

The pre-processing weighing filter 21 of the input section 10 has a first time versus amplitude response that opposes a second time versus amplitude response of the formants of the input speech signal. The formants represent key amplitude versus frequency responses of the speech signal that characterize the speech signal consistent with an linear predictive coding analysis of the LPC analyzer 30. The pre-processing weighting filter 21 is adjusted to compensate for the perceptually induced deficiencies in error minimization, which would otherwise result, between the reference speech signal (e.g., input speech signal) and a synthesized speech signal.

The input speech signal is provided to a linear predictive coding (LPC) analyzer 30 (e.g., LPC analysis filter) to determine LPC coefficients for the synthesis filters 42 (e.g., short-term predictive filters). The input speech signal is inputted into a pitch estimator 32. The pitch estimator 32 determines a pitch lag value and a pitch gain coefficient for voiced segments of the input speech. Voiced segments of the input speech signal refer to generally periodic waveforms.

The pitch estimator 32 may perform an open-loop pitch analysis at least once a frame to estimate the pitch lag. Pitch lag refers a temporal measure of the repetition component (e.g., a generally periodic waveform) that is apparent in voiced speech or voice component of a speech signal. For example, pitch lag may represent the time duration between adjacent amplitude peaks of a generally periodic speech signal. As shown in FIG. 3, the pitch lag may be estimated based on the weighted speech signal. Alternatively, pitch lag may be expressed as a pitch frequency in the frequency domain, where the pitch frequency represents a first harmonic of the speech signal.

The pitch estimator 32 maximizes the correlations between signals occurring in different sub-frames to determine candidates for the estimated pitch lag. The pitch estimator 32 preferably divides the candidates within a group of distinct ranges of the pitch lag. After normalizing the delays among the candidates, the pitch estimator 32 may select a representative pitch lag from the candidates based on one or more of the following factors: (1) whether a previous frame was voiced or unvoiced with respect to a subsequent frame affiliated with the candidate pitch delay; (2) whether a previous pitch lag in a previous frame is within a defined range of a candidate pitch lag of a subsequent frame, and (3) whether the previous two frames are voiced and the two previous pitch lags are within a defined range of the subsequent candidate pitch lag of the subsequent frame. The pitch estimator 32 provides the estimated representative pitch lag to the adaptive codebook 36 to facilitate a starting point for searching for the preferential excitation vector in the adaptive codebook 36. The adaptive codebook section 11 later refines the estimated representative pitch lag to select an optimum or preferential excitation vector from the adaptive codebook 36.

The speech characteristic classifier 26 preferably executes a speech classification procedure in which speech is classified into various classifications during an interval for application on a frame-by-frame basis or a subframe-by-subframe basis. The speech classifications may include one or more of the following categories: (1) silence/background noise, (2) noise-like unvoiced speech, (3) unvoiced speech, (4) transient onset of speech, (5) plosive speech, (6) non-stationary voiced, and (7) stationary voiced. Stationary voiced speech represents a periodic component of speech in which the pitch (frequency) or pitch lag does not vary by more than a maximum tolerance during the interval of consideration. Non-stationary voiced speech refers to a periodic component of speech where the pitch (frequency) or pitch lag varies more than the maximum tolerance during the interval of consideration. Noise-like unvoiced speech refers to the nonperiodic component of speech that may be modeled as a noise signal, such as Gaussian noise. The transient onset of speech refers to speech that occurs immediately after silence of the speaker or after low amplitude excursions of the speech signal. A speech classifier may accept a raw input speech signal, pitch lag, pitch correlation data, and voice activity detector data to classify the raw speech signal as one of the foregoing classifications for an associated interval, such as a frame or a subframe. The foregoing speech classifications may define one or more triggering characteristics that may be present in an interval of an input speech signal. The presence or absence of a certain triggering characteristic in the interval may facilitate the selection of an appropriate encoding scheme for a frame or subframe associated with the interval.

A first excitation generator 40 includes an adaptive codebook 36 and a first gain adjuster 38 (e.g., a first gain codebook). A second excitation generator 58 includes a fixed codebook 50, a second gain adjuster 52 (e.g., second gain codebook), and a controller 54 coupled to both the fixed codebook 50 and the second gain adjuster 52. The fixed codebook 50 and the adaptive codebook 36 define excitation vectors. Once the LPC analyzer 30 determines the filter parameters of the synthesis filters 42, the encoder 11 searches the adaptive codebook 36 and the fixed codebook 50 to select proper excitation vectors. The first gain adjuster 38 may be used to scale the amplitude of the excitation vectors of the adaptive codebook 36. The second gain adjuster 52 may be used to scale the amplitude of the excitation vectors in the fixed codebook 50. The controller 54 uses speech characteristics from the speech characteristic classifier 26 to assist in the proper selection of preferential excitation vectors from the fixed codebook 50, or a subcodebook therein.

The adaptive codebook 36 may include excitation vectors that represent segments of waveforms or other energy representations. The excitation vectors of the adaptive codebook 36 may be geared toward reproducing or mimicking the long-term variations of the speech signal. A previously synthesized excitation vector of the adaptive codebook 36 may be inputted into the adaptive codebook 36 to determine the parameters of the present excitation vectors in the adaptive codebook 36. For example, the encoder may alter the present excitation vectors in its codebook in response to the input of past excitation vectors outputted by the adaptive codebook 36, the fixed codebook 50, or both. The adaptive codebook 36 is preferably updated on a frame-by-frame or a subframe-by-subframe basis based on a past synthesized excitation, although other update intervals may produce acceptable results and fall within the scope of the invention.

The excitation vectors in the adaptive codebook 36 are associated with corresponding adaptive codebook indices. In one embodiment, the adaptive codebook indices may be equivalent to pitch lag values. The pitch estimator 32 initially determines a representative pitch lag in the neighborhood of the preferential pitch lag value or preferential adaptive index. A preferential pitch lag value minimizes an error signal at the output of the first summer 46, consistent with a codebook search procedure. The granularity of the adaptive codebook index or pitch lag is generally limited to a fixed number of bits for transmission over the air interface 64 to conserve spectral bandwidth. Spectral bandwidth may represent the maximum bandwidth of electromagnetic spectrum permitted to be used for one or more channels (e.g., downlink channel, an uplink channel, or both) of a communications system. For example, the pitch lag information may need to be transmitted in 7 bits for half-rate coding or 8-bits for full-rate coding of voice information on a single channel to comply with bandwidth restrictions. Thus, 128 states are possible with 7 bits and 256 states are possible with 8 bits to convey the pitch lag value used to select a corresponding excitation vector from the adaptive codebook 36.

The encoder 11 may apply different excitation vectors from the adaptive codebook 36 on a frame-by-frame basis or a subframe-by-subframe basis. Similarly, the filter coefficients of one or more synthesis filters 42 may be altered or updated on a frame-by-frame basis. However, the filter coefficients preferably remain static during the search for or selection of each preferential excitation vector of the adaptive codebook 36 and the fixed codebook 50. In practice, a frame may represent a time interval of approximately 20 milliseconds and a sub-frame may represent a time interval within a range from approximately 5 to 10 milliseconds, although other durations for the frame and sub-frame fall within the scope of the invention.

The adaptive codebook 36 is associated with a first gain adjuster 38 for scaling the gain of excitation vectors in the adaptive codebook 36. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The first excitation generator 40 is coupled to a synthesis filter 42. The first excitation vector generator 40 may provide a long-term predictive component for a synthesized speech signal by accessing appropriate excitation vectors of the adaptive codebook 36. The synthesis filter 42 outputs a first synthesized speech signal based upon the input of a first excitation signal from the first excitation generator 40. In one embodiment, the first synthesized speech signal has a long-term predictive component contributed by the adaptive codebook 36 and a short-term predictive component contributed by the synthesis filter 42.

The first synthesized signal is compared to a weighted input speech signal. The weighted input speech signal refers to an input speech signal that has at least been filtered or processed by the pre-processing weighting filter 21. As shown in FIG. 3, the first synthesized signal and the weighted input speech signal are inputted into a first summer 46 to obtain an error signal. A minimizer 48 accepts the error signal and minimizes the error signal by adjusting (i.e., searching for and applying) the preferential selection of an excitation vector in the adaptive codebook 36, by adjusting a preferential selection of the first gain adjuster 38 (e.g., first gain codebook), or by adjusting both of the foregoing selections. A preferential selection of the excitation vector and the gain scalar (or gain vector) apply to a subframe or an entire frame of transmission to the decoder 120 over the air interface 64. The filter coefficients of the synthesis filter 42 remain fixed during the adjustment or search for each distinct preferential excitation vector and gain vector.

The second excitation generator 58 may generate an excitation signal based on selected excitation vectors from the fixed codebook 50. The fixed codebook 50 may include excitation vectors that are modeled based on energy pulses, pulse position energy pulses, Gaussian noise signals, or any other suitable waveforms. The excitation vectors of the fixed codebook 50 may be geared toward reproducing the short-term variations or spectral envelope variation of the input speech signal. Further, the excitation vectors of the fixed codebook 50 may contribute toward the representation of noise-like signals, transients, residual components, or other signals that are not adequately expressed as long-term signal components.

The excitation vectors in the fixed codebook 50 are associated with corresponding fixed codebook indices 74. The fixed codebook indices 74 refer to addresses in a database, in a table, or references to another data structure where the excitation vectors are stored. For example, the fixed codebook indices 74 may represent memory locations or register locations where the excitation vectors are stored in electronic memory of the encoder 11.

The fixed codebook 50 is associated with a second gain adjuster 52 for scaling the gain of excitation vectors in the fixed codebook 50. The gains may be expressed as scalar quantities that correspond to corresponding excitation vectors. In an alternate embodiment, gains may be expresses as gain vectors, where the gain vectors are associated with different segments of the excitation vectors of the fixed codebook 50 or the adaptive codebook 36.

The second excitation generator 58 is coupled to a synthesis filter 42 (e.g., short-term predictive filter), which may be referred to as a linear predictive coding (LPC) filter. The synthesis filter 42 outputs a second synthesized speech signal based upon the input of an excitation signal from the second excitation generator 58. As shown, the second synthesized speech signal is compared to a difference error signal outputted from the first summer 46. The second synthesized signal and the difference error signal are inputted into the second summer 44 to obtain a residual signal at the output of the second summer 44. A minimizer 48 accepts the residual signal and minimizes the residual signal by adjusting (i.e., searching for and applying) the preferential selection of an excitation vector in the fixed codebook 50, by adjusting a preferential selection of the second gain adjuster 52 (e.g., second gain codebook), or by adjusting both of the foregoing selections. A preferential selection of the excitation vector and the gain scalar (or gain vector) apply to a subframe or an entire frame. The filter coefficients of the synthesis filter 42 remain fixed during the adjustment.

The LPC analyzer 30 provides filter coefficients for the synthesis filter 42 (e.g., short-term predictive filter). For example, the LPC analyzer 30 may provide filter coefficients based on the input of a reference excitation signal (e.g., no excitation signal) to the LPC analyzer 30. Although the difference error signal is applied to an input of the second summer 44, in an alternate embodiment, the weighted input speech signal may be applied directly to the input of the second summer 44 to achieve substantially the same result as described above.

The preferential selection of a vector from the fixed codebook 50 preferably minimizes the quantization error among other possible selections in the fixed codebook 50. Similarly, the preferential selection of an excitation vector from the adaptive codebook 36 preferably minimizes the quantization error among the other possible selections in the adaptive codebook 36. Once the preferential selections are made in accordance with FIG. 3, a multiplexer 60 multiplexes the fixed codebook index 74, the adaptive codebook index 72, the first gain indicator (e.g., first codebook index), the second gain indicator (e.g., second codebook gain), and the filter coefficients associated with the selections to form reference information. The filter coefficients may include filter coefficients for one or more of the following filters: at least one of the synthesis filters 42, the pre-processing weighing filter 21, the adaptive codebook weighting filter 23, and the fixed codebook weighting filter 25 and any other applicable filter.

A transmitter 62 or a transceiver is coupled to the multiplexer 60. The transmitter 62 transmits the reference information from the encoder 11 to a receiver 128 via an electromagnetic signal (e.g., radio frequency or microwave signal) of a wireless system as illustrated in FIG. 3. The multiplexed reference information may be transmitted to provide updates on the input speech signal on a subframe-by-subframe basis, a frame-by-frame basis, or at other appropriate time intervals consistent with bandwidth constraints and perceptual speech quality goals.

The receiver 128 is coupled to a demultiplexer 68 for demultiplexing the reference information. In turn, the demultiplexer 68 is coupled to a decoder 120 for decoding the reference information into an output speech signal. As shown in FIG. 3, the decoder 120 receives reference information transmitted over the air interface 64 from the encoder 11. The decoder 120 uses the received reference information to create a preferential excitation signal. The reference information facilitates accessing of a duplicate adaptive codebook and a duplicate fixed codebook to those at the encoder 70. One or more excitation generators of the decoder 120 apply the preferential excitation signal to a duplicate synthesis filter. The same values or approximately the same values are used for the filter coefficients at both the encoder 11 and the decoder 120. The output speech signal obtained from the contributions of the duplicate synthesis filter and the duplicate adaptive codebook is a replica or representation of the input speech inputted into the encoder 11. Thus, the reference data is transmitted over an air interface 64 in a bandwidth efficient manner because the reference data is composed of less bits, words, or bytes than the original speech signal inputted into the input section 10.

In an alternate embodiment, certain filter coefficients are not transmitted from the encoder to the decoder, where the filter coefficients are established in advance of the transmission of the speech information over the air interface 64 or are updated in accordance with internal symmetrical states and algorithms of the encoder and the decoder.

The synthesis filter 42 (e.g., a short-term synthesis filter) may have a response that generally conforms to the following equation:

$$\frac{1}{A(z)} = \frac{1}{1 - \sum_{i=1}^{P} a_{irevised} z^{-i}},$$

where 1/A(z) is the filter response represented by a z transfer function, $a_{i\ revised}$ is a linear predictive coefficient, i=1 . . . P, and P is the prediction or filter order of the synthesis filter. Although the foregoing filter response may be used, other filter responses for the synthesis filter 42 may be used. For example, the above filter response may be modified to include weighting or other compensation for input speech signals.

If the response of the synthesis filter 42 of the encoder 11 is expressed as 1/A(z), a response of a corresponding analysis filter of the decoder 120 or the LPC analyzer 30 is expressed as A(z) in accordance with the following equation:

$$A(z) = 1 - \sum_{i=1}^{P} a_{imodified} z^{-i}$$

where $a_{i\ modified}$ is the non-quantized equivalent of $a_{i\ revised}$. Thus, the same or similar bandwidth expansion constants or filter coefficients may be applied to a synthesis filter 42, a corresponding analysis filter, or both. During coding, the analysis filter coefficients (i.e., $a_{i\ modified}$) are applied to a bandwidth expansion and then quantized. Synthesis filter coefficients (i.e., $a_{i\ revised}$) are derivable from the expanded, quantized analysis filter coefficients.

The encoder 11 may encode speech differently in accordance with differences in the detected spectral characteristics of the input speech. If the spectral response is regarded as generally sloped in accordance with a defined characteristic slope (e.g., first spectral response), the pre-processing weighting filter 21 may use a first value for the weighting constant (e.g., $\alpha$=0.2). On the other hand, if the spectral response is regarded as generally flat (e.g., second spectral response), the pre-processing weighting filter 21 may use a second value for the weighting constant (e.g., $\alpha$=0) distinct from the first value of the weighting constant. The first value of the weighting constant is an example of a first coding parameter value and the second value of the weighting constant is an example of a second coding parameter value.

In one embodiment, the encoder of FIG. 3 includes a controller 27 for controlling the pre-processing weighting filter 21, the fixed-codebook weighting filter 25, or both. In one embodiment, the controller 27 receives an input signal related to the spectral content of the input speech signal from a spectral detector 221 or a spectral analyzer. In another embodiment, the speech characteristic classifier 26 (e.g., detector 24) or the pitch pre-processing module 22 provides an input that defines the spectral content of the input speech signal.

In one embodiment, the pre-processing weighting filter 21 comprises a core weighting filter component and a low-pass filter component. Further, the low-pass filter component may be selectively activated or deactivated in response to the spectral content of the input speech signal. The activation of the low-pass filter component may be used to enhance the periodicity of the modified weighted speech signal, derived from the input speech signal.

In one example, the filter response for the pre-processing weighting filter may be expressed as the following equation:

$$W_A(z) = (1 + \alpha Z^{-1})\frac{A(z/\gamma_1)}{A(z/\gamma_2)},$$

where 1/A(z) is an LPC synthesis filter response, $\alpha$ is a low-pass adaptive coefficient, and $\gamma_1$ and $\gamma_2$ are constant coefficients. In an alternate embodiment, $\gamma_1$ and $\gamma_2$ may represent adaptive coefficients, rather than constant coefficients. The core weighting component of the above pre-processing filter equation is:

$$\frac{A(z/\gamma_1)}{A(z/\gamma_2)}.$$

The low-pass filter component of the above equation is $1+(\alpha Z^{-1}$

In one illustrative embodiment, the low-pass adaptive coefficient $\alpha$ has a value between 0 and 0.3. Further, $\gamma_1$ may fall within a range between 0.9 and 0.97, whereas $\gamma_2$ may fall within a range between 0.4 and 0.6.

In one embodiment, the adaptive codebook weighting filter comprises the core weighting filter component. In one example, the adaptive codebook weighting filter may be expressed as the following equation.

$$W_B(z) = \frac{A(z/\gamma_1)}{A(z/\gamma_2)}$$

where 1/A(z) is the LPC synthesis filter response, $\gamma_1$ and $\gamma_2$ are constant coefficients. In an alternate embodiment, $\gamma_1$ and $\gamma_2$ may represent adaptive coefficients, rather than constant coefficients.

In one illustrative embodiment, $\gamma_1$ may fall within a range between 0.9 and 0.97, whereas $\gamma_2$ may fall within a range between 0.4 and 0.6.

In one embodiment, the fixed codebook weighting filter 25 comprises a core weighting filter component and a high-pass filter component. Further, the high-pass filter component may be selectively activated or deactivated in response to the spectral content of the speech signal to improve the spectral characteristics of the encoded and reproduced speech signals.

In one example, the filter response for the fixed-codebook weighting filter 25 may be expressed as the following equation:

$$W_C(z) = (1 - \mu Z^{-1})\frac{A(z/\gamma_1)}{A(z/\gamma_2)},$$

where 1/A(z) is the LPC synthesis filter response is $\mu$ is a high-pass adaptive coefficient, and $\gamma_1$ and $\gamma_2$ are constant coefficients. In an alternate embodiment, $\gamma_1$ and $\gamma_2$ may represent adaptive coefficients rather than constant coefficients. The core weighting component of the fixed codebook filter of the above equation is $$\frac{A(z/\gamma_1)}{A(z/\gamma_2)}.$$

The high-pass filter component of the above equation is $1-\mu Z^{-1}$.

In one illustrative embodiment, the high-pass adaptive coefficient has a value between 0 and 0.5. Further, $\gamma_1$ may fall within a range between 0.9 and 0.97, whereas $\gamma_2$ may fall within a range between 0.4 and 0.6.

In an alternate embodiment, the frequency response of the perceptual weighting filter (21, 23, or 25) may be expressed generally as the following equation:

$$W(z) = \frac{1}{1-\alpha z^{-1}} \frac{1+\sum_{i=1}^{P} a_i \rho^i z^{-i}}{1+\sum_{i=1}^{P} a_i \beta^i z^{-i}}$$

where $\alpha$ is a weighting constant, $\rho$ and $\beta$ are preset coefficients (e.g., values from 0 to 1), P is the predictive order or the filter order of the perceptual weighting filter 20, and $\{a_i\}$ is the linear predictive coding coefficient. The perceptual weighting filter 21 controls the value of $\alpha$ based on the spectral response of the input speech signal.

For example, in the adjusting or selection of preferential coding parameter values, different values of the weighting constant $\alpha$ may be selected to adjust the frequency response of the perceptual weighting filter in response to the determined slope or flatness of the speech signal. In one embodiment, $\alpha$ approximately equals 0.2 for generally sloped input speech consistent with the MIRS spectral response or a first spectral response. Similarly, in one embodiment $\alpha$ approximately equals 0 for an input speech signal with a generally flat signal response or a second spectral response.

A multi-rate encoder may include different encoding schemes to attain different transmission rates over an air interface. Each different transmission rate may be achieved by using one or more encoding schemes. The highest coding rate may be referred to as full-rate coding. A lower coding rate may be referred to as one-half-rate coding where the one-half-rate coding has a maximum transmission rate that is approximately one-half the maximum rate of the full-rate coding. An encoding scheme may include an analysis-by-synthesis encoding scheme in which an original speech signal is compared to a synthesized speech signal to optimize the perceptual similarities or objective similarities between the original speech signal and the synthesized speech signal. A code-excited linear predictive coding scheme (CELP) is one example of an analysis-by synthesis encoding scheme. Although the signal processing system of the invention is primarily described in conjunction with an encoder 11 that is well-suited for fall-rate coding and half-rate coding, the signal processing system of the invention may be applied to lesser coding rates than half-rate coding or other coding schemes.

Figure 4I:
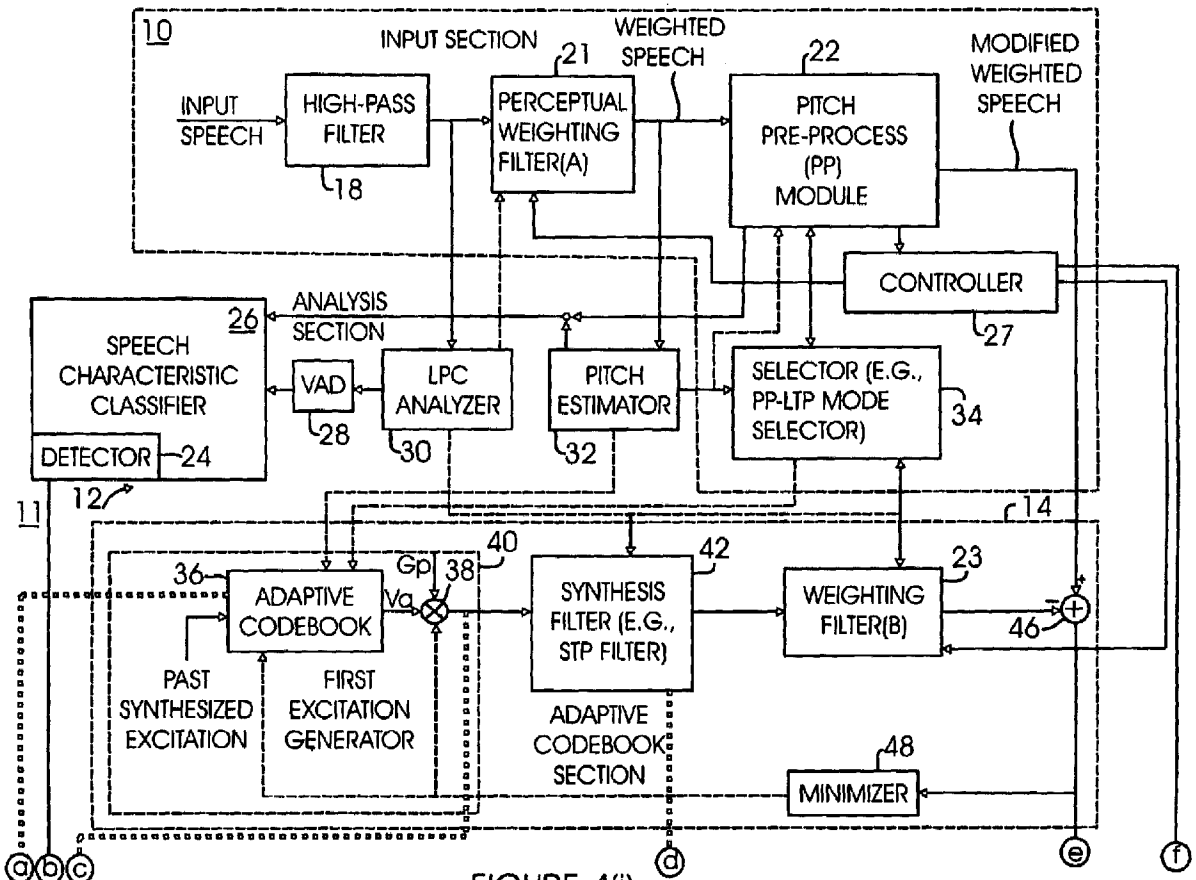
FIG. 4 is a block diagram of an alternate embodiment of an encoder in accordance with the invention.
Figure 4:
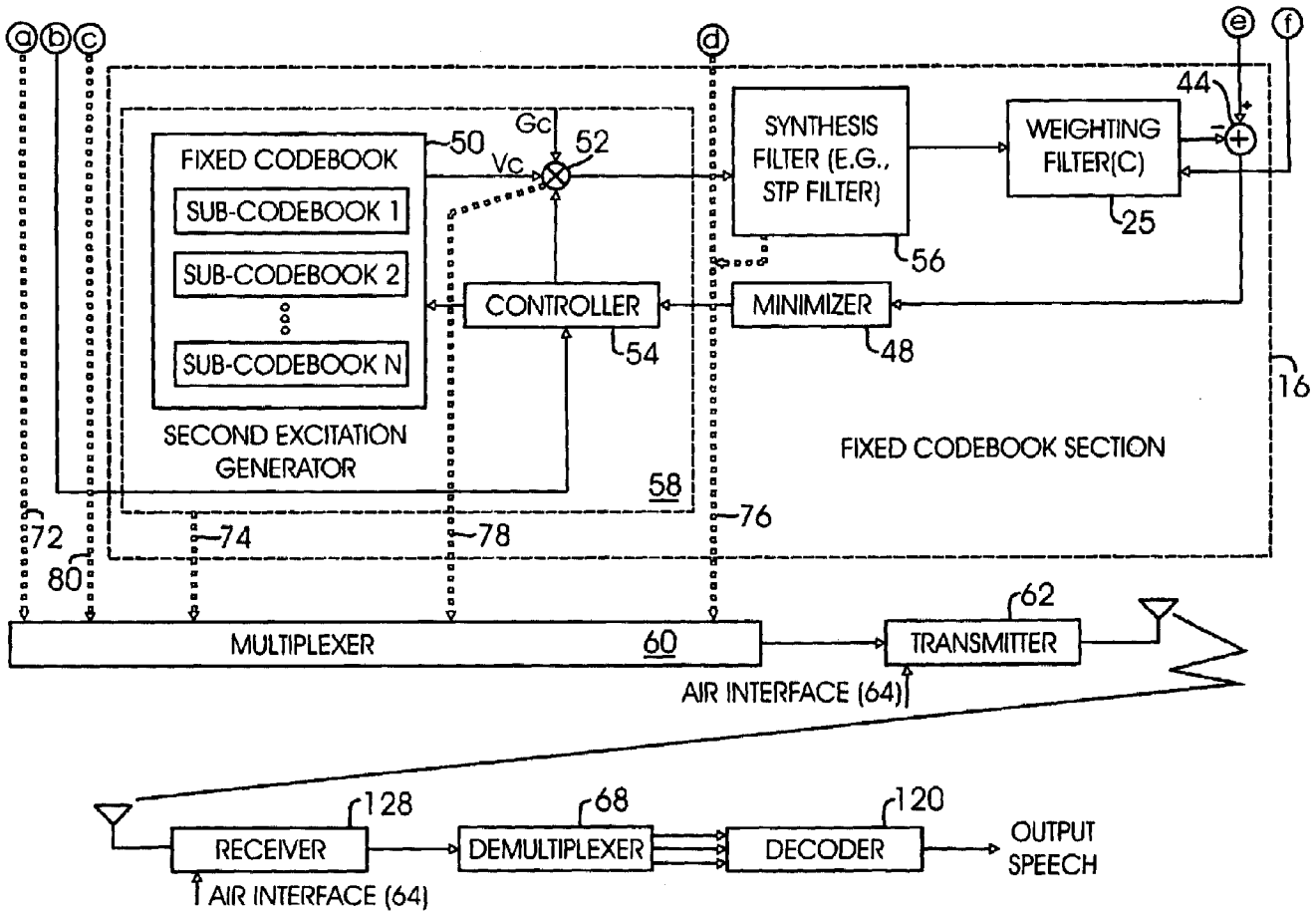

FIG. 4 shows a block diagram of an alternate embodiment of an encoder 111. The encoder 111 of FIG. 4 is similar to the encoder 11 except the controller 27 of FIG. 4 is coupled to the adaptive-codebook weighting filter 23 for controlling at least one filtering parameter or filter coefficient of the adaptive-codebook weighting filter 23. Like reference numbers in FIG. 3 and FIG. 4 indicate like elements. The controller 27 may adjust the value of $\gamma_1$ and $\gamma_2$ of the adaptive codebook weighting filter 23 in response to the spectral content of the input speech signal.

Figure 5:
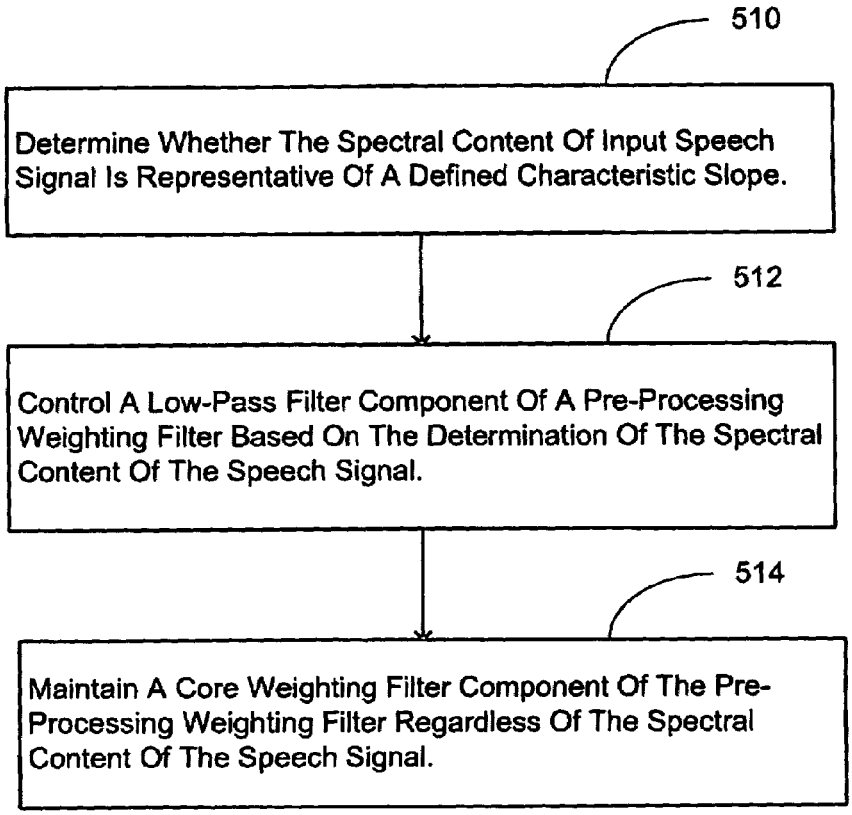
FIG. 5 is a flow chart for controlling at least one weighting filter for encoding a speech signal in accordance with the invention.

FIG. 5 is a flow chart of a method for controlling one or more weighting filters (e.g., 21, 23 and 25) of an encoder (11 or 111) based on the spectral content of an input speech signal. Each weighting filter may be associated with a particular portion or section of the encoder (11 or 111). The control of the weighting filter or the weighting filter itself may differ based on an affiliation of the weighting filter with a particular portion (.e.g., section) or location in the encoder (11 or 111). The portion or location of the weighting filter (21, 23, and 25) in the encoder (11 or 111) may be described with reference to one or more of the following sections of the filter: the input section 10, the analysis section 12, the adaptive codebook section 14, and the fixed codebook section 16. For example, as shown in FIG. 3 and FIG. 4, the perceptual weighting filter 21 is located in the input section 10; the adaptive weighting filter 23 is located in the adaptive codebook section 14; and the fixed weighting filter 25 is located in the fixed codebook section 16. At least one of the weighting filters (e.g., 21, 23 and 25) comprises a frequency-specific component that has a response tailored to the particular portion of the encoder in which the frequency-specific component resides, consistent with perceptual quality considerations of the reproduced speech signal.

In an alternate embodiment, the location of each weighting filter may be described with reference to one or more modules (e.g., the pitch pre-processing module 22, synthesis filter 42, or synthesis filter 56) or signal paths that interconnect the modules within the encoder (11 or 111). The physical or logical signal paths may be indicated by the arrows in FIG. 3, for example. The arrows interconnecting the modules or components of FIG. 3 may represent physical signal paths, logical signal paths, or both.

The method of FIG. 5 may be implemented with relatively low complexity, while enhancing the perceptual quality of the reproduced speech. The method of controlling the weighting filter promotes maximizing the bandwidth of the reproduced speech and reducing the potential distortion introduced by MIRS-compliant telecommunications networks into coded speech.

In step S100, an encoder (e.g., 11 or 111) or a spectral detector 221 determines whether the spectral content of an input speech signal is representative of a defined spectral characteristic. For example, the spectral detector 221 or a spectral analyzer may determine whether or not the input speech signal has a defined spectral slope as the defined spectral characteristic. The defined spectral slope may comprise an MIRS response, an IRS response, the first spectral response, the second spectral response, and the third spectral response, or some other spectral response.

In step S102, an encoder (e.g., 11 or 111) or a controller 27 controls a filter parameter (e.g., coefficient) or a filter response of a weighting filter (e.g., 21, 23 and 25) based on one or more of the following: (1) the determination of the spectral content of the speech signal and (2) the affiliation of the weighting filter in the encoder 11 with a particular location, portion or section of the encoder 11. For example, the controller 27 may control a frequency-specific filter component of a subject weighting filter (e.g., 21, 23 or 25) based on the determination of the spectral content of the speech signal or/and the location of a subject weighting filter in the encoder (11 or 111).

To control a filter response of a weighting filter in step S102, the controller 27 may control a frequency-specific filter component the weighting filter. The control of the weighting filters (e.g., 21, 23 and 25) may differ with the identity of the weighting filters. With respect to a low-pass filter component of a pre-processing weighting filter 21, the controller 27 may control the pre-processing weighting filter 21 based on the determination of the spectral content of the speech signal. If the spectral detector 221 determines that the spectral content of the input speech signal is consistent with a low-frequency energy that falls below a low frequency energy threshold, the controller 27 may activate a low-pass filter component of a pre-processing weighting filter 21 to change a spectral response of the pre-processing weighting filter 21.

Alternately, the controller 27 may change filter parameters of a low-pass filter component of a pre-processing weighting filter 21 to increase filtering or attenuation of the low pass filter component, if the spectral detector 221 determines that the spectral content of the input speech signal is consistent with a low frequency energy that falls below a low frequency energy threshold.

With respect to a high-pass filter component of a fixed codebook weighting filter 25, the controller 27 may control the high-pass filter component based on the determination of the spectral content of the speech signal. For example, the controller 27 may control a high-pass filter component of a fixed codebook weighting filter 25 in response to the detection or absence of a noisy speech component or undesired noise (e.g., background noise) of the input speech signal. Undesired noise means an unwanted noise signal or background noise, as opposed to a desired noisy speech component that contributes to the accurate reproduction of a speech signal. If the spectral detector 221 detects an undesired noise level (e.g., an undesired background noise level) that meets or exceeds a minimum threshold level, the controller 27 may activate or otherwise invoke the high pass filter component to attenuate or remove the undesired noise (e.g., undesired background noise). However, if the undesired noise level (e.g., undesired background noise level) is less than the minimum threshold level, the high pass filter component is deactivated or decreased.

In an alternate embodiment, if the spectral detector 221 or the speech characteristic classifier 26 detects a noisy speech component that meets or exceeds a minimum threshold level (i.e., magnitude) over a certain spectral range, the controller 27 may activate or control a response (e.g., a complex response, as opposed to a high pass response) of a fixed codebook weighting filter 25 to maximize or increase the bandwidth (e.g., higher fidelity) of the reproduced speech signal.

In step S104, a core weighting filter component of the weighting filter is maintained regardless of the spectral content of the input speech signal. In one embodiment, even if the frequency specific component of the weighting filter was adjusted in step S102, the core weighting filter component is kept the same in step S104. In one configuration, the core weighting filter component may be defined by a filter response that does not lead to a perceptual degradation of the reproduced speech signal, even if the spectral response of the input speech signal varies or departs from a generally flat spectral response.

In an alternate embodiment, one or more filter parameters of the core weighting filter component may be changed in response to the spectral content of the input speech signal to enhance the perceptual quality of the reproduced speech. The core weighting filter component may be associated with one or more of the following: a pre-processing weighting filter 21, a fixed codebook weighting filter 25, and an adaptive-codebook weighting filter 23.

Figure 6:
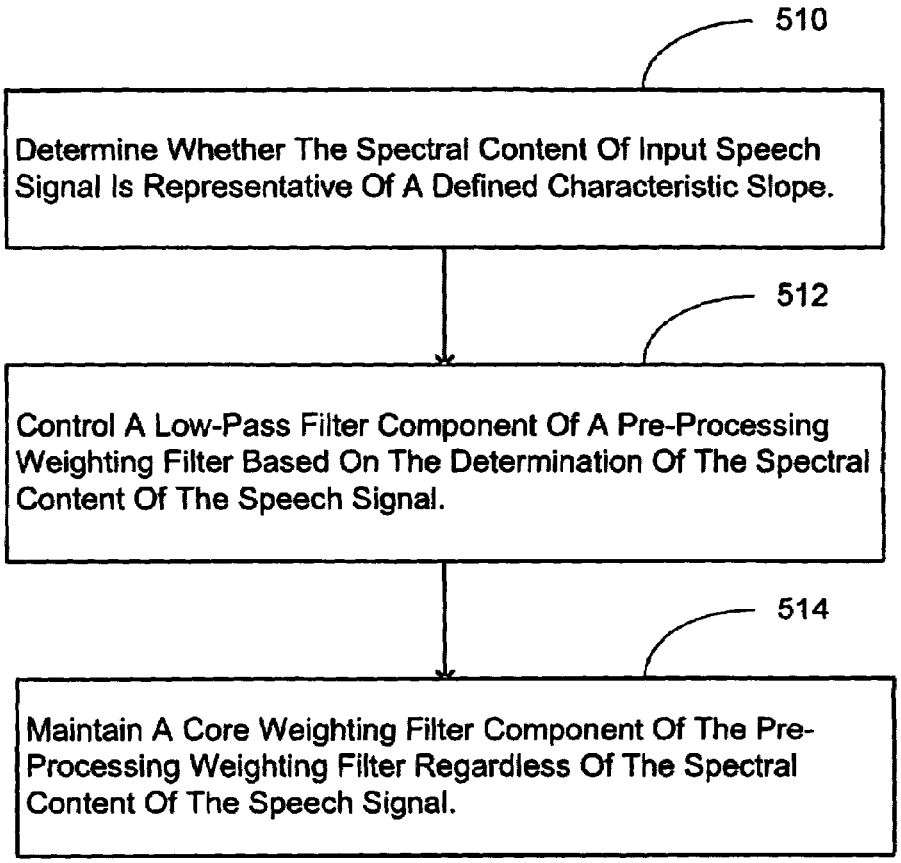
FIG. 6 is flow chart for controlling a pre-processing weighting filter for encoding a speech signal in accordance with the invention.

FIG. 6 is a flow chart of a method for controlling a pre-processing weighting filter 21 in response to a spectral content of an input speech signal. The pre-processing weighting filter 21 comprises a low-pass filter component and a core weighting filter component. The low-pass filter component (e.g., $1+\alpha Z^{-1}$) may be selectively activated. For example, if inactive, the pre-processing weighting filter 21 conforms to a first filter response of:

$$W_A(z) = \frac{A(z/\gamma_1)}{A(z/\gamma_2)},$$

where 1/A(z) is an LPC synthesis filter response and $\gamma_1$ and $\gamma_2$ are constant coefficients. Conversely, if active, the pre-processing weighting filter 21 conforms to the a second filter response of:

$$W_A(z) = (1+\alpha Z^{-1})\frac{A(z/\gamma_1)}{A(z/\gamma_2)},$$

where 1/A(z) is an LPC synthesis filter response, $\alpha$ is a low-pass adaptive coefficient, and $\gamma_1$ and $\gamma_2$ are constant coefficients.

The method of FIG. 6 starts in step S10. In step S10, a spectral detector 221 or a spectral analyzer of encoder is associated with an encoder (e.g., 11 or 111). The spectral detector 221 or the analyzer determines whether or not the spectral content of an input speech signal is representative of a defined characteristic slope. For example, the defined characteristic slope may comprise an MIRS slope, an IRS slope, or some other slope of magnitude versus frequency of the input speech signal.

In step S12, a controller 27 of the encoder (e.g., 11 or 111) controls a low-pass filter component of a pre-processing weighting filter 21 based on the determination of the spectral content of the input speech signal. The pre-processing weighting filter 21 adapts in response to the spectral content of the input speech signal.

Step S12 may be carried out in accordance with several alternative techniques, which may or may not overlap in their scope. Under a first technique for executing step S12, if the spectral tilt of the speech signal is consistent with an MIRS or an IRS spectral response, the controller 27 activates or increases the contribution of the low-pass filter component of the pre-processing filter 21.

Under a second technique for executing step S12, if the spectral detector 221 detects or determines that the spectral tilt of the input speech signal is consistent with a low frequency energy that falls below a low frequency energy threshold, the controller 27 activates or increases the contribution of the low pass filter component of the pre-processing filter 21. However, if the detector 24 determines that the spectral tilt of the speech signal is consistent with a low frequency energy that meets or exceeds a low frequency energy threshold, the controller 27 deactivates, bypasses or decreases the contribution of the low pass filter component in the digital domain. The activation, deactivation, or bypass of the low-pass filter component is readily realized in the digital domain by digital signal processing or otherwise.

Accordingly, the control of the low-pass filter component facilitates the maintenance of a generally periodic nature of a speech signal. The pre-processing weighting filter 21 has a spectral response that is designed to maintain the generally periodic component of the input speech signal. If the periodic nature of the speech signal is maintained, the open-loop pitch search and coding may be executed with greater efficiency. In general, periodic speech signals may be represented accurately with fewer bits, for transmission over the air interface, than nonperiodic speech signals require for the same level of perceptual quality of the reproduced speech.

In an alternate embodiment of step S12, filter parameters of the pre-processing weighting filter 21 are changed in response to detection of the presence or the absence of a spectral tilt in the input speech signal. For example, if the detector determines that the spectral tilt of the input speech signal is consistent with a low frequency energy that falls below a low frequency energy threshold, the filter parameters of the pre-processing weighting filter 21 are changed to activate or increase a contribution of the low-pass filtering of a low-pass filter component of the pre-processing filter. However if the detector determines that the spectral tilt of the speech signal is consistent with a low frequency energy that meets or exceeds a low frequency energy threshold, the filter parameters of the preprocessing filter are changed to deactivate or decrease the contribution of low-pass filtering of the a low-pass filter component of the pre-processing filter.

In step S14 after step S12, the encoder maintains a core weighting filter component of the pre-processing weighting filter 21 regardless of the spectral content of the speech signal. Accordingly, even though the low-pass filter component of the pre-processing weighting filter 21 may be changed, the core weighting filter component of the pre-processing weighting filter 21 may remain the same.

In one embodiment, the adaptive codebook weighting filter may be adjusted in addition to the pre-processing weighting filter 21. The adaptive codebook filter may comprise a core weighting filter component. The weighting filter may be controlled in accordance with several alternate control techniques following step S10 or elsewhere in the method of FIG. 6. Under a first control technique, the weighting filter component of the adaptive codebook is static. Under a second control technique, the filter parameters may be adaptive to improve the searching of the adaptive codebook.

Figure 7:
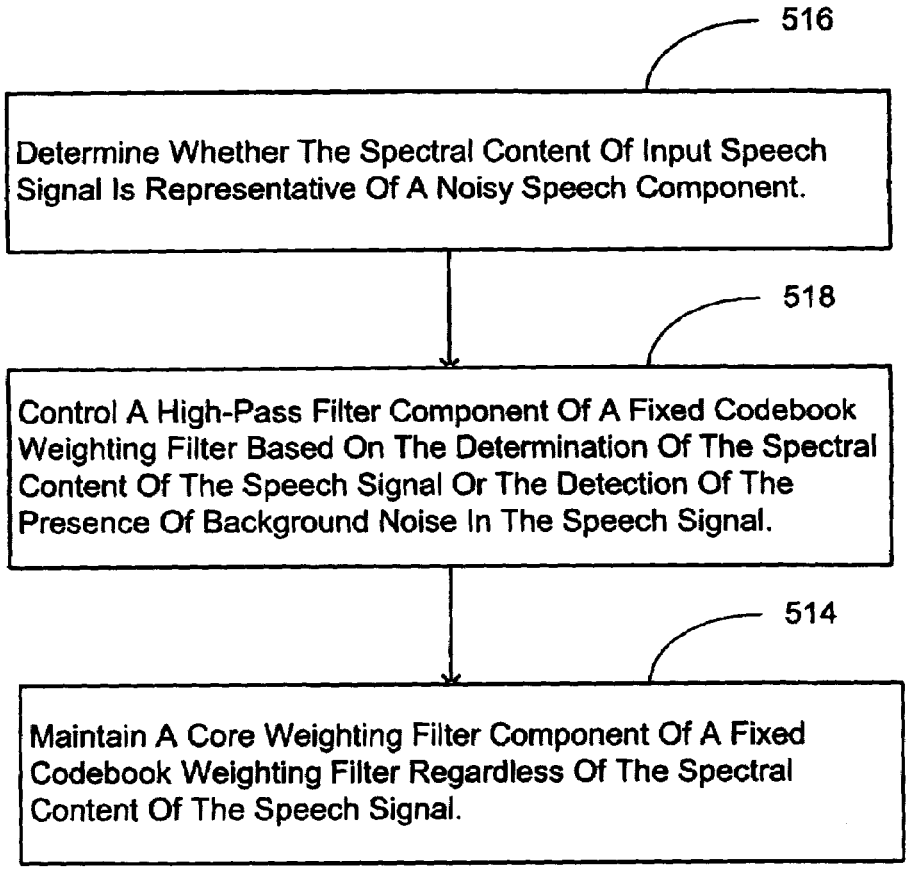
FIG. 7 is a flow chart for controlling a fixed codebook weighting filter for encoding a speech signal in accordance with the invention.

FIG. 7 is a flow chart of a method for controlling a weighting filter, such as a fixed codebook weighting filter 25, in response to a spectral content of an input speech signal. The fixed codebook weighting filter 25 may comprise a weighting filter component and a high-pass filter component that conforms to the following equation:

$$W_C(z) = (1 - \mu Z^{-1})\frac{A(z/\gamma_1)}{A(z/\gamma_2)},$$

where 1/A(z) is the LPC synthesis filter response is $\mu$ is a high-pass adaptive coefficient, and $\gamma_1$ and $\gamma_2$ are constant coefficients. In the above equation, the weighting filter component is $$\frac{A(z/\gamma_1)}{A(z/\gamma_2)},$$

and the high-pass filter component is $(1-\mu Z^{-1})$. Like steps or procedures in FIG. 6 and FIG. 7 are indicated by like reference numbers.

The method of FIG. 7 starts in step S16. In step S16, a spectral detector 221 or a spectral analyzer of the encoder (e.g., 11 or 111) determines whether the spectral content of an input speech signal is representative of a noisy speech component or undesired noise (e.g., undesired background noise). A noisy speech component refers to a natural constituent component of certain sounds ordinarily made during speech. If the noisy speech component of speech is not accurately reproduced, the resultant decoded speech signal may sound artificial, mechanical, or distorted, for example. The background noise represents unwanted noise that detracts from or might detract from the accurate reproduction of a speech signal. If a noisy speech signal is combined with background noise, the combined signal may be treated as undesired noise in accordance with the principles of any method or embodiment of the invention disclosed herein.

The spectral detector 221 may detect whether a noisy speech component or an undesired background noise exceeds a high frequency energy threshold over a certain defined range. In one embodiment, the spectral detector 221 may determine whether a spectral content of the speech signal is tilted such that the high frequency components have a greater magnitude than the lower frequency components as information for deciding how to control the filtering of the high-pass filter component.

In step S18, a controller 27 of the encoder (e.g., 11 or 111) controls a high-pass filter component of a fixed codebook weighting filter 25 based on one or more of the following: (1) the determination of the spectral content (of step S16) of the speech signal, (2) the detection of the presence of the background noise in speech signal, and (3) the detection of the presence of the noisy speech component in the speech signal. For example, if the detected background noise level meets or exceeds a minimum threshold in a certain spectral range, the presence of background noise is detected and the high-pass filter component of the fixed codebook weighting filter 25 may be activated or otherwise invoked to suppress the unwanted background noise. However, if the detected background noise level falls below the minimum threshold, the high pass filter component may be deactivated or made inactive to maximize the bandwidth of the output speech signal and to maintain the high frequency energy of a noisy speech component.

Step S18 may be carried out as follows. If the high pass filter component is deactivated or inactive the fixed codebook weighting filter 25 has the response of $$W_c(z) = \frac{A(z/\gamma_1)}{A(z/\gamma_2)}.$$

Conversely, if the high pass filter component is activated or active, the fixed codebook weighting filter 25 response has the response of $$W_C(z) = (1 - \mu Z^{-1})\frac{A(z/\gamma_1)}{A(z/\gamma_2)}.$$

The fixed codebook weighting filter 25 may activate or deactivate the high-pass filter component (e.g., $1-\mu Z^{-1}$) in response to the detection or absence of at least one of a noisy speech component and background noise of the input speech. The high-pass filter component is arranged to increase the bandwidth of the output speech signal so that the output speech sounds more natural. If the detector or speech classifier 26 determines that the input speech signal has a noisy speech component of sufficient magnitude over a spectral range, the high pass filter component may be controlled (e.g., changed to inactive or activated in a frequency selective manner with respect to the spectral range) to maximize the bandwidth of the output speech signal and to maintain the high frequency energy.

In an alternate embodiment, filter parameters of the fixed codebook weighting filter 25 are changed in response to detection of the presence or the absence of a noisy speech component in the input speech signal. For example, if the detector (24 or 221) or speech classifier 26 determines that the high frequency range of the input speech signal is consistent with a high frequency energy that contains background noise components, the filter parameters of the fixed-codebook weighting filter are changed to activate or increase the contribution of high-pass filtering of a high-pass filter component of the fixed-codebook weighting filter. However if the detector (24 or 221) or speech classifier 26 determines that the spectral content of the speech signal is consistent with a high frequency energy that does not have background noise component, the filter parameters of the fixed codebook weighting filter 25 are changed to deactivate or decrease the contribution of the high-pass filter component.

In step S14 after step S18, the encoder maintains a core weighting filter component of the fixed-codebook weighting filter 25 regardless of the spectral content of the speech signal. Accordingly, even though the high-pass filter component of fixed codebook weighting filter 25 may be changed, the core weighting component may remain static or unchanged. Similarly, the controller 27 may change a first filter response or first set of filter parameters of one weighting filter, without changing a second filter response or a second set of filter parameters for another weighting filter.

In one embodiment, the adaptive codebook weighting filter 23 may comprise a core weighting filter component. The adaptive codebook weighting filter 23 may be controlled in accordance with several alternate control techniques. Under a first control technique, the core weighting filter component of the adaptive codebook is static. Under a second control technique, the filter parameters, associated with the core weighting filter parameters, may be adaptive to improve the searching of the adaptive codebook.

While various embodiments of the invention have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A method for preparing a speech signal for encoding, the method comprising:

providing a pitch pre-processing weighting filter including a core weighting filter component and a low-pass filter;

providing a fixed-codebook weighting filter including the core weighting filter component and a high-pass filter;

providing an adaptive-codebook weighting filter including the core weighting filter component;

determining whether a spectral content of the speech signal is representative of a defined spectral characteristic;

controlling said low-pass filter and said high-pass filter based on a determination of the spectral content of the speech signal.

2. The method according to claim 1 wherein the determining step comprises determining a defined spectral slope as the defined spectral characteristic.

3. The method according to claim 1 wherein the controlling step comprises activating the low-pass filter if the spectral content of the speech signal is consistent with a low frequency energy that falls below a low frequency energy threshold.

4. The method according to claim 1 wherein the controlling step comprises changing filter parameters of the low-pass filter to increase a contribution of the low-pass filter to a resultant spectral response of the pitch pre-processing weighting filter, if the spectral content of the speech signal is consistent with a low frequency energy that falls below a low frequency energy threshold.

5. The method according to claim 1 wherein the controlling step comprises controlling the high-pass filter in response to a detection or absence of at least one of unwanted background noise and a noisy speech component of the speech signal.

6. The method according to claim 1 wherein the controlling step comprises activating the high-pass filter in response to a detection of background noise or undesired noise that meets or exceeds a threshold magnitude level over a certain spectral range.

7. The method according to claim 1 wherein the controlling step comprises controlling filter parameters of the adaptive codebook weighting filter in response to the determination of the spectral content of the speech signal.

8. The method according to claim 1 wherein the core weighting filter component is expressed as the following equation:

$$W_A(z)=A(Z/\gamma_1)/A(Z/\gamma_2),$$

where 1/A(z) is an LPC synthesis filter response and $\gamma_1$ and $\gamma_2$ are constant coefficients.

9. The method according to claim 1 wherein a filter response for the pitch pre-processing weighting filter is expressed as the following equation:

$$W_A(z)=(1+\alpha Z^{-1})A(Z/\gamma_1)/A(Z/\gamma_2),$$

where 1/A(z) is an LPC synthesis filter response, $\alpha$ a is low-pass adaptive coefficient, and $\gamma_1$ and $\gamma_2$ are constant coefficients.

10. The method according to claim 9 wherein the low-pass adaptive coefficient has a value between 0 and 0.3, $\gamma_1$ falls within a range between 0.9 and 0.97, and $\gamma_2$ falls within a range between 0.4 and 0.6.

11. The method according to claim 1 wherein a filter response for the pitch pre-processing weighting filter is expressed as the following equation:

$$W_A(z)=(1+\alpha Z^{-1})A(Z/\gamma_1)/A(Z/\gamma_2),$$

where 1/A(z) is an LPC synthesis filter response, $\alpha$ is a low-pass adaptive coefficient, and $\gamma_1$ and $\gamma_2$ are adaptive coefficients.

12. The method according to claim 11 wherein the low-pass adaptive coefficient has a value between 0 and 0.3, $\gamma_1$ falls within a range between 0.9 and 0.97, and $\gamma_2$ falls within a range between 0.4 and 0.6.

13. The method according to claim 1 wherein a filter response for the fixed-codebook weighting filter is expressed as the following equation:

$$W_C(z)=(1-\mu Z^{-1})\,A(Z/\gamma_1)/A(Z/\gamma_2),$$

where 1/A (z) is an LPC synthesis filter response, $\mu$ is a high-pass adaptive coefficient, and $\gamma_1$ and $\gamma_2$ are constant coefficients.

14. The method according to claim 13 wherein the high-pass adaptive coefficient has a value between 0 and 0.5, $\gamma_1$ falls within a range between 0.9 and 0.97, and $\gamma_2$ falls within a range between 0.4 and 0.6.

15. The method according to claim 1 wherein a filter response for the fixed-codebook weighting filter is expressed as the following equation:

$$W_C(z)=(1-\mu Z^{-1})\,A(Z/\gamma_1)/A(Z/\gamma_2),$$

where 1/A (z) is an LPC synthesis filter response, $\mu$ is a high-pass adaptive coefficient, and $\gamma_1$ and $\gamma_2$ are adaptive coefficients.

16. The method according to claim 15 wherein the first adaptive coefficient has a value between 0 and 0.5, $\gamma_1$ falls within a range between 0.9 and 0.97, and $\gamma_2$ falls within a range between 0.4 and 0.6.

17. An encoder for encoding a speech signal, the encoder comprising:

a pitch pre-processing weighting filter including a core weighting filter component and a low-pass filter;

a fixed-codebook weighting filter including the core weighting filter component and a high-pass filter;

an adaptive-codebook weighting filter the core weighting filter component;

a spectral detector for determining whether a spectral content of the speech signal is representative of a defined spectral characteristic;

a controller adapted to control said low-pass filter and said high-pass filter based on a determination of the spectral content of the speech signal.

18. The encoder according to claim 17 wherein the controller activates the low-pass filter in response to a determination that a low frequency energy of the speech signal falls below a low frequency energy threshold.

19. The encoder according to claim 17 wherein the controller activates the high-pass filter in response to a detection of a background noise that meets or exceeds a magnitude level over a certain spectral range.

20. The encoder according to claim 17 wherein the controller controls filter parameters of the adaptive codebook weighting filter in response to the determination of the spectral content of the speech signal.

21. The encoder according to claim 17 wherein the core weighting filter component is expressed as the following equation:

$$W_A(z)=A(Z/\gamma_1)/A(Z/\gamma 2),$$

where 1/A(z) is an LPC synthesis filter response and $\gamma_1$ and $\gamma_2$ are constant coefficients.

22. The encoder according to claim 17 wherein a filter response for the pitch pre-processing weighting filter is expressed as the following equation:

$$W_A(z)=(1\alpha Z^{-1})\,A(Z/\gamma_1)/A(Z/\gamma_2),$$

where 1/A(z) is an LPC synthesis filter response, $\alpha$ is a low-pass adaptive coefficient, and $\gamma_1$ and $\gamma_2$ are constant coefficients.

23. The encoder according to claim 22 wherein the low-pass adaptive coefficient has a value between 0 and 0.3, $\gamma_1$ falls within a range between 0.9 and 0.97, and $\gamma_2$ falls within a range between 0.4 and 0.6.

24. The encoder according to claim 17 wherein a filter response for the pitch pre-processing weighting filter is expressed as the following equation:

$$W_A(z)=(1\alpha Z^{-1})\,A(Z/\gamma_1)/A(Z/\gamma_2),$$

where 1/A(z) is an LPC synthesis filter response, $\alpha$ is a low-pass adaptive coefficient, and $\gamma_1$ and $\gamma_2$ are adaptive coefficients.

25. The encoder according to claim 24 wherein the low-pass adaptive coefficient has a value between 0 and 0.3, $\gamma_1$ falls within a range between 0.9 and 0.97, and $\gamma_2$ falls within a range between 0.4 and 0.6.

26. The encoder according to claim 17 wherein a filter response for the fixed-codebook weighting filter is expressed as the following equation:

$$W_C(z)=(1-\mu Z^{-1})\,A(Z/\gamma_1)/A(Z/\gamma_2),$$

where 1/A (z) is an LPC synthesis filter response, $\mu$ is a high-pass adaptive coefficient, and $\gamma_1$ and $\gamma_2$ are constant coefficients.

27. The encoder according to claim 26 wherein the high-pass adaptive coefficient has a value between 0 and 0.5, $\gamma_1$ falls within a range between 0.9 and 0.97, and $\gamma_2$ falls within a range between 0.4 and 0.6.

28. The encoder according to claim 17 wherein a filter response for the fixed-codebook weighting filter is expressed as the following equation:

$$W_C(z)=(1-\mu Z^{-1})\,A(Z/\gamma_1)/A(Z/\gamma_2),$$

where 1/A (z) is an LPC synthesis filter response, $\mu$ is a high-pass adaptive coefficient, and $\gamma_1$ and $\gamma_2$ are adaptive coefficients.

29. The encoder according to claim 28 wherein the first adaptive coefficient has a value between 0 and 0.5, $\gamma_1$ falls within a range between 0.9 and 0.97, and $\gamma_2$ falls within a range between 0.4 and 0.6.

* * * * *

UNITED STATES PATENT AND TRADEMARK OFFICE

CERTIFICATE OF CORRECTION

PATENT NO. : 7,010,480 B2
APPLICATION NO. : 09/953470
DATED : March 7, 2006
INVENTOR(S) : Gao et al.

It is certified that error appears in the above-identified patent and that said Letters Patent is hereby corrected as shown below:

Column 24, line 11, "$(1\alpha Z^{-1})$" should be changed to --$( 1 + \alpha Z^{-1})$--.

Column 24, line 23, "$(1\alpha Z^{-1})$" should be changed to --$( 1 + \alpha Z^{-1})$--.

Signed and Sealed this

Twelfth Day of September, 2006

JON W. DUDAS
*Director of the United States Patent and Trademark Office*